United States Patent [19]

Majoor

[11] 4,213,577

[45] Jul. 22, 1980

[54] EXPANDABLE COILER MANDREL

[75] Inventor: Hendrik Majoor, Beverwijk, Netherlands

[73] Assignee: Hoogovens Ijmuiden, B.V., Ijmuiden, Netherlands

[21] Appl. No.: 9,306

[22] Filed: Feb. 5, 1979

[30] Foreign Application Priority Data

Feb. 6, 1978 [NL] Netherlands ..... 7801309

[51] Int. Cl.[2] ..... B65H 75/24

[52] U.S. Cl. ..... 242/72 R; 242/74.1

[58] Field of Search ..... 242/72 R, 72 B, 78.3, 242/110; 279/2 R, 2 A; 82/44

[56] References Cited

U.S. PATENT DOCUMENTS

| | | | |
|---|---|---|---|
| 2,321,146 | 6/1943 | Jones | 242/74.1 |
| 4,147,312 | 4/1979 | Secor | 242/72 R |

FOREIGN PATENT DOCUMENTS

| | | | |
|---|---|---|---|
| 1265528 | 4/1968 | Fed. Rep. of Germany | 242/72 B |
| 2310950 | 12/1976 | Fed. Rep. of Germany | 242/72 R |
| 1074746 | 4/1954 | France | 242/72 |

*Primary Examiner*—Edward J. McCarthy

*Attorney, Agent, or Firm*—Stevens, Davis, Miller & Mosher

[57] ABSTRACT

An expandable coiler mandrel has a core, radially movable segments around the core and hydraulic pistons to move the segments outwardly. To provide a mandrel in which all movements are actuated hydraulically, and in which tilting of the segments during expansion is avoided, the segments are secured to the pistons which are annular and mounted around pins having heads to limit the movement of the segments. The pistons can be urged in either direction by hydraulic fluid, to expand and retract the mandrel. Fluid for expansion is supplied by pressure cylinders. The pistons associated with a single segment are actuated by at least two of the pressure cylinders.

7 Claims, 3 Drawing Figures

EXPANDABLE COILER MANDREL

BACKGROUND OF THE INVENTION

1. Field of the Invention

This invention relates to an expandable coiler mandrel for coiling sheet metal and the like.

2. Description of the Prior Art

Expandable coiler mandrels are frequently used in rolling mills for metal strip and sheet, recoiler equipment and the like. A strip is coiled tightly onto the expanded segments of the mandrel and can be removed later from the mandrel by moving the segments inwardly.

A typical conventional construction for a mandrel has a core, a plurality of radially expandable segments mounted around the core and, for each segment, a plurality of hydraulic piston-and-cylinder units by which the segments are movable radially, these being connected to the hydraulic units within the core.

Such a mandrel is shown in U.S. Pat. No. 2,321,146; other examples are French Pat. Nos. 1,074,746 and 2 310 950. A variation shown in French Pat. No. 1 367 531 has wedges which push the segments outwardly, the wedges themselves being moved by a piston-and-cylinder unit. In all of these, the piston units act to move the segments outwardly against the force of inwardly acting return springs, which cause retraction of the segments when the hydraulic pressure is released. The segments are not fixed to the pistons. This means that the fluid has to overcome the force of the springs in order to expand the pistons. Additionally, this mixture of hydraulic and mechanical operation is a complication and is liable to lead to vibrations or oscillations.

Another problem unsolved by the prior art is that of tilting of the segments, if for instance one piston jams or is faulty. In the above specifications, a common hydraulic feed to all pistons is shown.

SUMMARY OF THE INVENTION

The present invention therefore has as its object the provision of a coiler mandrel which overcomes the problem of the prior art and in particular a mandrel in which mechanical actuation is avoided, in which the hydraulic drive does not have to overcome the force of counter-acting springs, which is simple in construction and in which uniform movement of the segments without tilting is promoted.

The invention provides a coiler mandrel having a core, radially movable segments around the core, and hydraulic piston-and-cylinder units to move the segments. The segments are secured to the pistons, which are annular in shape and are guided by pins fixed in the core. These pins also limit the outward movement of the segments. The segments are both expanded and contracted hydraulically, so that return springs are avoided.

Because the transmission of force now takes place only by means of the pressure fluid, it is possible to have a construction which is far simpler from a mechanical point of view, which in addition requires no separate greasing. The relatively moving parts of the mandrel are lubricated by the pressure fluid itself, while only comparatively slight forces are transmitted between surfaces of moving parts touching each other. The new construction requires minimum maintenance, and can be constructed symmetrically in a simple way. The latter is definitely an asset when achieving rotational balance of the coiler mandrel.

It is also beneficial, for trouble-free operation, that the segments are moved outwardly by fluid supplied by the pressure cylinders whose pistons move in common with the pistons of each single segment connected to more than one pressure cylinder (i.e., in no case are all the pistons of a segment connected to the same pressure cylinder.) This means that the segments are prevented from moving outwards unequally or tilting during expansion. Because the pressure pistons move in common in the pressure cylinders, which however in turn are connected independently of each other to the first chambers of the annular pistons, these annular pistons are moved outwards independently of each other, but at the same time.

French Pat. No. 1 369 471 shows four pressure cylinders used to provide an independent supply of pressurised fluid to inflatable elements located between the core and the expandable segments. The problems of supply to inflatable elements are different from those of supply to rigid cylinders and pistons.

To provide a construction which is particularly simple and elegant it is preferred that the core has an axial bore which contains fluid distributor blocks at the locations of the hydraulic units, the blocks making a fluid tight fit with the bore and having circumferential grooves forming passages with the bore wall and communicating on the one hand with passages in the core leading to said first and second chambers and on the other hand with passages within the block leading to fluid supply tubes extending axially along the bore, e.g., from the pressure cylinders.

In this manner the first chambers are coupled to the pressure cylinders, and the second chambers may also be coupled by such tubes to a supply of pressure fluid, by which the pressure is applied, the annular pistons and consequently the segments are retracted to the core.

It is also preferred to connect the supply to the pressure cylinders via non-return valves, in order that the pressure cylinders and the first chambers are kept filled.

The number of segments, of piston-and-cylinder units per segment, of pressure cylinders and the method of coupling the pressure cylinders to the different first chambers can be varied to suit the particular case. However, a construction which is very reliable during operation as well as simple in construction may be obtained if the mandrel has four segments with four hydraulic units per segment, while there are eight pressure cylinders, connected to the distribution blocks by eight tubes within the bore.

A construction which is easy to assemble and disassemble is possible if the segments which have axially extending grooves which receive hooked or flanged lugs on the annular pistons. With this arrangement it is possible to attach the segments to the annular pistons by axial movement.

BRIEF DESCRIPTION OF THE DRAWINGS

An embodiment of the invention is desribed below by way of example with reference to the accompanying drawings, in which.

DESCRIPTION OF THE PREFERRED EMBODIMENTS

Figure 1B:
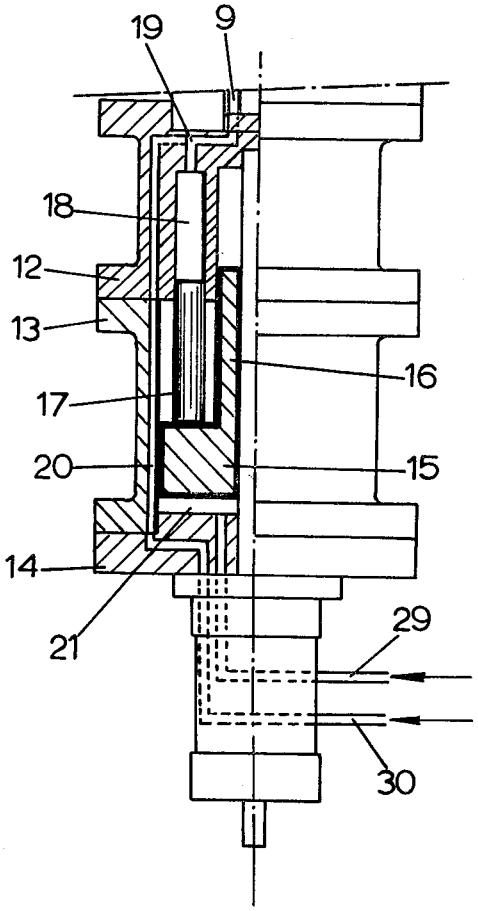
FIG. 1*b* shows partly in axial section and partly in side view the other end of the mandrel where driven.
Figure 1A:
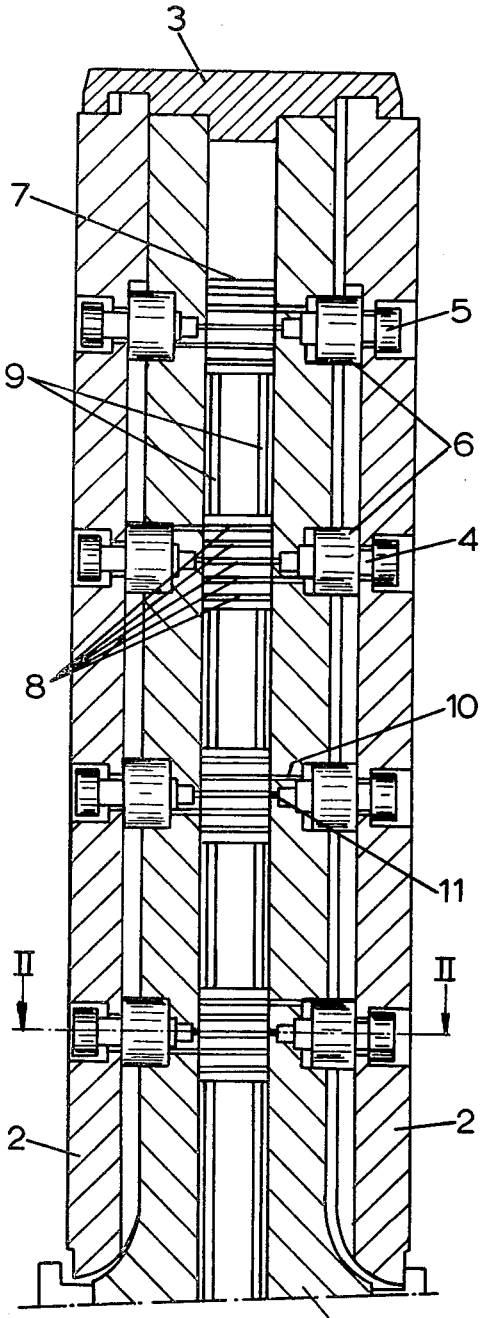
FIG. 1*a* shows, partly in axial section and partly in side view, one end of the coiler mandrel embodying the invention for carrying a coil.

FIG. 1*a* shows the end of a core 1 of the coiler mandrel, i.e. what is seen here is the location at which a strip is, in use, coiled onto the mandrel. Around core 1 are arranged four radially movable segments 2 which are closed to the core by a cover 3 at the end of the mandrel. The segments 2 can move radially along pins 4 up to a limit provided by enlarged heads 5 of the pins 4. The segments 2 are coupled to annular pistons 6, by which they can be moved both outwards and inwards as will be explained below.

In a central axially extending throughbore of the core are four distribution blocks 7, which each have five circumferential grooves 8 in their cylindrical surfaces. The grooves 8 form passages with the wall of the bore, and are connected by passages within the distribution blocks, (see FIG. 2) to axially extending tubes 9 which connect the distribution blocks with each other and to a feed system for the pressure fluid. The feed system is drawn schematically in FIG. 1*b* and is located in the back part of the coiler mandrel.

The two ends which are shown in FIGS. 1*a* and 1*b* are part of one and the same coiler mandrel. Between the parts shown are the usual bearing and driving systems for the mandrel. Since these do not in principle differ from those of conventional constructions of coiler mandrels, and are not relevant to the invention, they are not shown or described here.

The back part of the coiler mandrel shown in FIG. 1*b* comprises three blocks 12, 13 and 14, in which a movable annular body 15 having a guide sleeve 16, is located between a plurality of pressure cylinders 18 and a collecting chamber 21. Mounted on the ring 15 are eight pressure pistons 17, which are respectively movable in the eight pressure cylinders 18. Each of the pressure cylinders 18 is connected, independently of the other cylinders 18, via a passage 19 with one of the tubes 9. This tube 9 is itself connected to two of the first chambers associated with the pistons 6.

Eight passages 20 bypass the pressure cylinders 18 and are connected via a connection 30 to a supply unit for the pressure fluid. Four of these passages 20 are respectively in direct connection with a further four of the tubes 9, these four tubes 9 being connected to the second chambers associated with the pistons 6. The remaining four passages 20 each contain a non-return valve (not illustrated in the figure), and are connected to the passages 19, in order that the fluid system comprising the pressure cylinders and the first chambers is kept filled.

The chamber 21 is also connected to the supply unit for pressure fluid, via a passage 29. If fluid is supplied under pressure via the passage 29, while there is no pressure on the fluid in channel 30, the ring 15 is moved axially (upwards as drawn in FIG. 1*b*). The combination of the ring 15 and the pressure pistons 17 acts as a pressure multiplier, so that fluid is conveyed under extremely high pressure (e.g., 200 kg/cm$^2$) behind the pistons 6 via the passages 19; 9; 8 and 10. As a result the segments 2 are moved into the expanded condition of the mandrel.

If the pressure on 29 is released and pressure is applied via the connection 30, the second chambers described below are energized via four of the passages 20 and the pistons 6 are driven back, retracting the segments 2. At the same time the cylinders 18 are filled via the other four of the passages 20.

Figure 2:
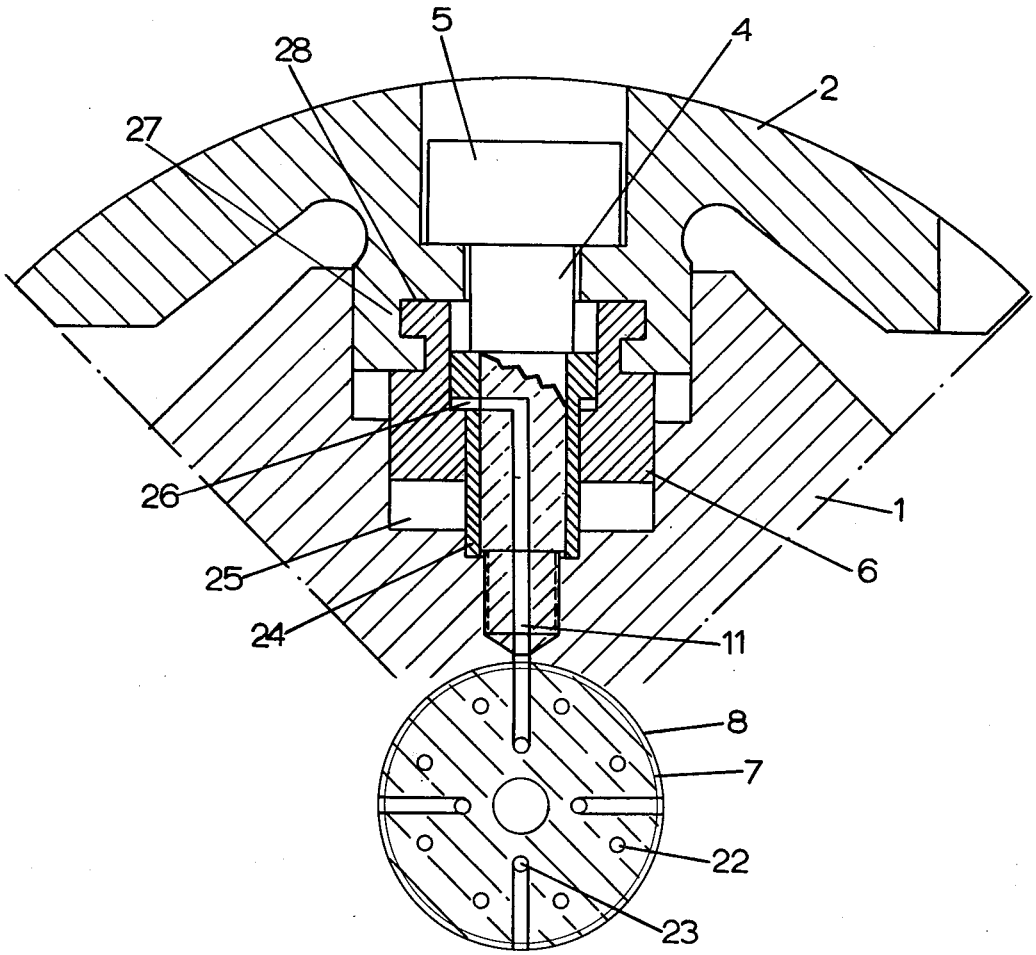
FIG. 2 is a cross section on an enlarged scale of a quadrant of the coiler mandrel, on the line II—II of FIG. 1*a*.

FIG. 2 shows in more detail how the annular piston 6 has end faces respectively in the two chambers 25 and 26 (the so-called first and second chambers respectively). The piston 6 moves along a guide body 24, which itself is mounted on the shank of the pin 4. The pin 4 is firmly secured in the core 1. The chamber 25 (the first chamber) is connected via a passage 10 (out of the plane of this view—see FIG. 1A) to one of the grooves 8 in the distribution block 7 while the chamber 26 (the second chamber) is connected via a passage 11, extending centrally through pin 4 to the central one of the grooves 8. The passage 10 is joined within the distribution block 7 to one of eight bores 22, arranged in a circle as seen in FIG. 2, while the passage 11 is connected in a similar manner to one of a second, inner circle of bores 23.

The bores 22 are connected respectively to the eight tubes 9 which are connected to the passages 19 (FIG. 16). The four bores 23 are respectively connected to the four tubes 9 which are connected to the above-mentioned four passages 20 connected directly to the supply line 30. Although they need not be shown here in detail it is of importance to ensure that the connections of the chambers 25 to the grooves 8 and the connections of the grooves 8 to the tubes 9 are such that for none of the segments 2 are all the chambers 25 connected to one and the same pressure cylinder 18. The aim of this is to prevent a segment 2 starting to tilt during expansion of the mandrel. In fact, with four segments 2 and eight cylinders 18, each segment may be arranged to be actuated by two of the cylinders 18.

To ensure that pistons 6 carry the segments 2, the latter are provided with axially extending grooves 27, in which hooked or flanged lugs 28 on the pistons are received. It is thus possible to remove the segments by sliding them axially after removal of the cover 3 and the pins 4.

What is claimed is:

1. In an expandable coiler mandrel, having a core, a plurality of radially expandable segments mounted around the core and, for each segment, a plurality of hydraulic units within the core, each comprising a piston and a cylinder by which the segments are movable radially, these being connected to the hydraulic units with the improvement that the segments are secured to the pistons of said hydraulic units, which pistons are annular and are mounted around pins which are themselves fixed to the core and have heads limiting the radially outward movement of the segments, there being first and second chambers for hydraulic fluid respectively at the radially inner and outer sides of the piston whereby the hydraulic units are operable to cause retraction as well as expansion of the segments, the said first chambers of the hydraulic units, for causing expansion of the segments, being connected to a plurality of pressure cylinders the pistons of which are arranged to be moved in common, and the connections being such that the said first chambers associated with a single segment are respectively connected to at least two different pressure cylinders.

2. Coiler mandrel according to claim 1 wherein said pressure cylinders are arranged parallel to each other in a circle in a part of said core axially spaced from the segments, and their pistons are connected to a ring for movement in common in the axial direction of the core.

3. Coiler mandrel according to claim 1 wherein the core has an axial bore which contains fluid distributor blocks at the locations of the hydraulic units, the blocks making a fluid tight fit with the bore and having circumferential grooves forming passages with the bore wall and communicating on the one hand with passages in the core leading to said first and second chambers and on the other hand with passages within the block leading to fluid supply tubes extending axially along the bore.

4. Coiler mandrel according to claim 3 wherein there are four of said segments, each having four of said hydraulic units, there being eight pressure cylinders each of which is connected to two of said hydraulic units.

5. Coiler mandrel according to claim 4 wherein said eight pressure cylinders are connected to the distributor blocks by eight of said tubes which as seen in cross section of the core are arranged in the bore on a circle around the axis of the core, there being a further four of said axially extending tubes for supply pressured fluid to said second chambers, for causing retraction of the segments, which four tubes are arranged in the bore on a second circle as seen in cross section of the core.

6. A coiler mandrel according to any one of claims 1, 2 and 3 wherein the segments have axially extending grooves which receive flanged lugs on the pistons in order to secure the segments to the pistons.

7. An expandable coiler mandrel, comprising a core, a plurality of radially movable segments mounted on said core and spaced around the circumference of the core, a plurality of pins extending outwardly from said core towards each said segment and having heads located within said segments in a manner so as to form abutments limiting outward movement of the segment, a plurality of hydraulic piston-and-cylinder units mounted on the core and arranged to cause outward and inward movement of said segments so as to expand or retract the mandrel, the pistons of each said unit being annular, being secured to the respective segment and being mounted around one of the said pins which thus acts as a guide for the piston, the piston-and-cylinder unit having first and second chambers for hydraulic fluid respectively at the inner and outer sides of the piston whereby the piston can be driven both radially inwardly and radially outwardly, there being a plurality of pressure cylinders having pistons which are arranged to be moved in common, the pressure cylinders being connected to said first chambers to cause expansion of the mandrel in such a manner that the said first chambers associated with a single one of the segments are not all connected to the same pressure cylinder.

* * * * *